United States Patent [19]

Bogart

[11] 4,301,925

[45] Nov. 24, 1981

[54] BAG WITH OPENING AND RECLOSING FEATURE

[75] Inventor: William M. Bogart, Bloomington, Minn.

[73] Assignee: Bemis Company, Inc., Minneapolis, Minn.

[21] Appl. No.: 108,163

[22] Filed: Dec. 28, 1979

[51] Int. Cl.[3] ..... B65D 33/30

[52] U.S. Cl. ..... 206/616; 206/621; 229/65

[58] Field of Search ..... 206/616–619, 206/621; 229/65, 62

[56] References Cited

U.S. PATENT DOCUMENTS

| | | | |
|---|---|---|---|
| 2,108,741 | 2/1938 | Betner | 229/65 |
| 2,307,735 | 1/1943 | Fehr | 206/616 X |
| 2,373,744 | 4/1945 | Coghill | 229/62 X |
| 2,415,139 | 2/1947 | Kohl | 229/65 X |
| 2,819,010 | 1/1958 | Amiguet | 229/62 |
| 3,024,962 | 3/1962 | Meister | 229/62 |
| 3,047,206 | 7/1962 | Monahan et al. | 229/62X |
| 3,116,002 | 12/1963 | Crawford et al. | 229/17 G |
| 3,215,335 | 11/1965 | Turpin | 229/62 X |
| 3,215,336 | 11/1965 | Turpin | 206/618 X |
| 3,243,099 | 3/1966 | Winegard | 229/62 |
| 3,272,425 | 9/1966 | Bendersky et al. | 206/616 X |
| 3,353,662 | 11/1967 | Pickin | 229/65 X |
| 3,534,520 | 10/1970 | Moran | 229/65 X |
| 3,536,189 | 10/1970 | Gallagher | 229/65 X |
| 3,545,668 | 12/1970 | Hultberg | 229/65 |

*Primary Examiner*—Stephen Marcus

*Attorney, Agent, or Firm*—Senniger, Powers, Leavitt and Roedel

[57] ABSTRACT

A bag having a top closure adapted to be opened for opening the bag at its mouth and for reclosing the bag, comprising a closure strip extending around the mouth of the bag from one wall of the bag to the other overlying and sealed to the outside of the walls. The ends of the strip project outwardly beyond the sides of the bag and form ears. A closure element carried by the strip extends lengthwise of the strip and a tearing member carried by the strip extends lengthwise thereof above the mouth edges of the walls and above the closure element. The bag is adapted to be opened by grasping one end of the tearing member and pulling it to tear the strip, and the portions of the closure element in the ears projecting outwardly beyond the sides of the bag are adapted to be bent to reclose the bag.

21 Claims, 13 Drawing Figures

BAG WITH OPENING AND RECLOSING FEATURE

BACKGROUND OF THE INVENTION

This invention relates to bags, and more particularly to bags with an easy opening and reclosing feature.

The invention is especially concerned with paper bags for flour, e.g., five, ten and twenty-five pound bags of flour, which heretofore have not had any wholly satisfactory means for facilitating opening the bag for removal of part of the flour and for reclosing the bag to retain and protect the remainder of the flour. It will be understood, of course, that the bags may be used for products other than flour, e.g., sugar.

SUMMARY OF THE INVENTION

Among the several objects of the invention may be noted the provision of a bag, especially a paper bag for flour or the like, with an easy opening and reclosing feature whereby the bag may be easily opened for removal of part of its contents and then easily reclosed as often as may be needed by the purchaser of the filled bag; and the provision of such a bag which, as initially filled and closed and before being opened is generally sift-proof.

In general, a bag of this invention has opposed walls and a top closure closing the mouth of the bag adapted to be opened for opening the bag at its mouth and adapted for reclosing the bag. The top closure comprises closure strip means extending around the mouth of the bag from one wall of the bag to the other overlying and sealed to the outside of the walls, the ends of the closure strip means projecting outwardly beyond the sides of the bag and forming ears. A closure element, e.g., a bendable metal wire, is carried by the strip means extending lengthwise thereof. The bag is adapted to be opened by opening the closure strip means above the closure element, the portions of the closure element in the ears projecting outwardly beyond the sides of the bag being adapted to be bent to reclose the bag.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
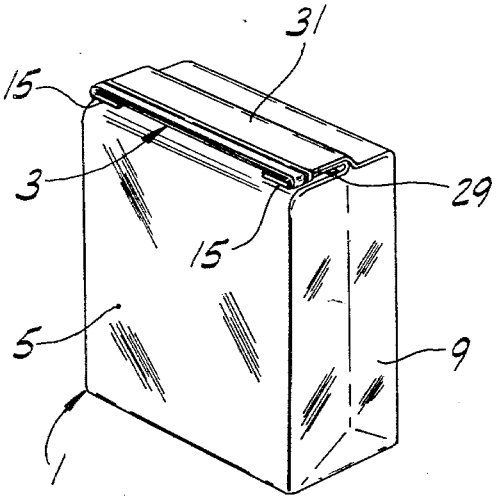
FIG. 1 is a perspective of a filled bag having a top closure of this invention.

Referring to the drawings, first more particularly to FIGS. 1–8, there is generally indicated at 1 a bag to which is applied a top closure 3 of this invention. This bag will generally be a paper bag, e.g., a relatively small bag for flour, sugar etc., and may be of multi-ply or single-ply construction. As shown, it is what is referred to in the art as a self-opening square bottom bag (an SOS bag) having opposed walls indicated at 5 and 7 and gussets indicated at 9. Wall 5 may be referred to as the front wall, and wall 7 as the back wall. The walls and the gussets are flush cut at the mouth of the bag, the mouth edges of the walls 5 and 7 being indicated at *5a* and *7a* in FIG. 4, and the mouth edges of the gussets 9 being indicated at *9a*. While the invention is shown as applied to an SOS bag, it will be understood that it may be applied to other types of bags, e.g., a flat tube (ungusseted) bag.

Figure 3:
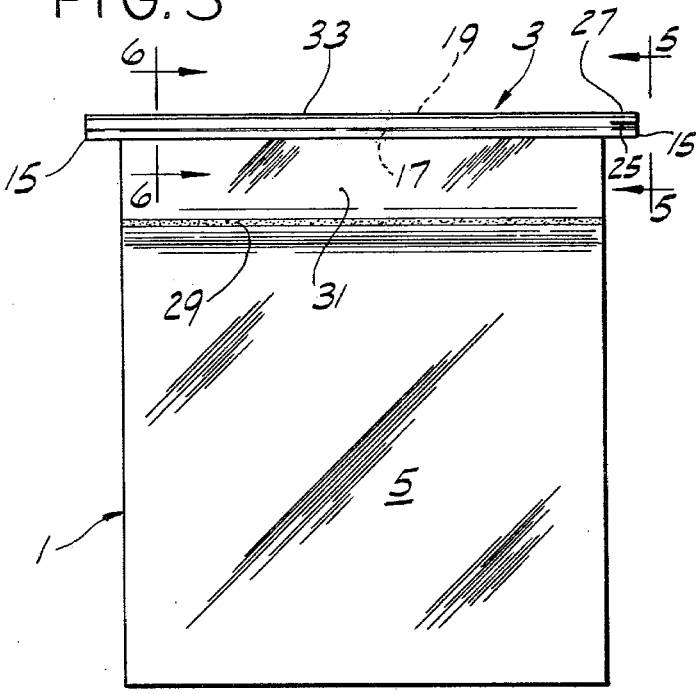
FIG. 3 is a front elevation of the bag in its FIG. 2 condition, on a larger scale than FIG. 2.
Figure 2:
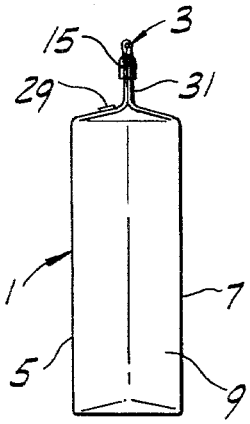
FIG. 2 is a side elevation of the bag of FIG. 1 showing the upper portion of the bag pulled up to a vertical position for opening the bag.
Figure 4:
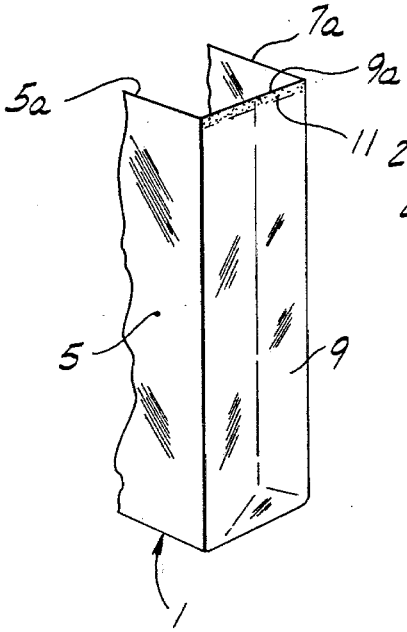
FIG. 4 is a fragmentary perspective showing an application of adhesive at the upper end of a gusset of the bag.

As shown in FIGS. 1–3, the bag is in its filled condition, having been filled with flour, sugar or similar product to a level below the mouth edges of the bag. The upper portions of the front and back walls above the contents of the bag are pressed together in flatwise relation and the upper portions of the gussets are intucked between the walls. The bag, as manufactured, is provided with strips of adhesive at 11 on the outside surfaces of the gussets adjacent the mouth edges *9a* of the gussets, the adhesive used here preferably being a relatively low-strength thermoplastic adhesive. The adhesive at 11 seals the front and back panels of the gussets together at the upper ends of the gussets when the top of the bag is closed, as will appear.

The closure 3, which is sealed around the top of the filled bag, is adapted readily to be opened for opening the bag and has means incorporated therein for readily reclosing the bag as will appear. Generally, it comprises strip means 13 which extends around the mouth of the bag from one wall of the bag to the other, this strip means being sealed to the outside of the walls to seal the filled bag and adapted to be torn to open the bag. The strip means is of greater length than the width of the bag and is applied to the top of the filled bag projecting beyond the side edges of the top of the bag, e.g., projecting approximately one inch beyond each side edge of the bag, to form ear portions 15. Closure 3 also comprises at least one reclosing element constituted by wire 17 carried by the strip means 13 extending lengthwise of the strip means on the outside of one of the walls below the mouth edge of the wall, and at least one tearing member 19 extending lengthwise of the strip means above the mouth edges of the walls. The bag is adapted to be opened by grasping the tearing member 19 at an end thereof and pulling it to tear the strip means so as to open the strip means 13 above the wire 17, and is adapted to be reclosed, after the strip means has been so torn open, by bending the end portions of the wire 17.

Figure 5:
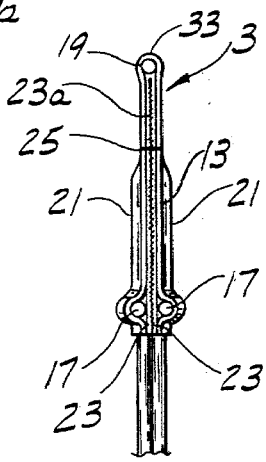
FIG. 5 is an enlarged right side view of the top of the bag on line 5—5 of FIG. 3 showing the strip means, wires and a tearing member of the top closure.
Figure 6:
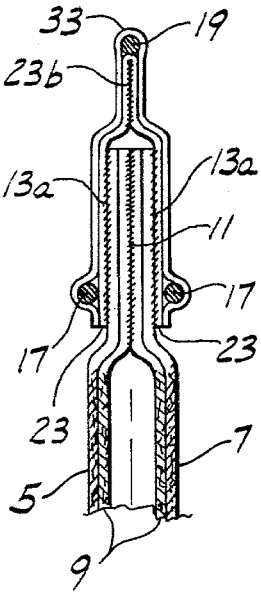
FIG. 6 is an enlarged vertical section on line 6—6 of FIG. 3, cross-hatching being in part omitted for clarity.
Figure 7:
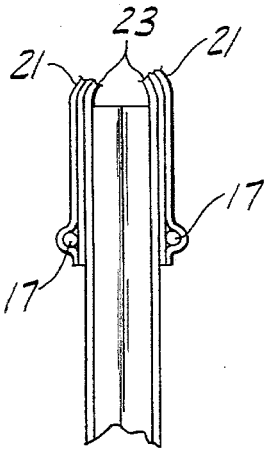
FIG. 7 is an enlarged fragmentary view on line 7—7 of FIG. 8.

Referring to FIGS. 5 and 6, the strip means 13 is shown to be a single strip or tape heat-sealable on one side, folded generally on its longitudinal center line around the mouth of the bag with its heat-sealable side on the inside and heat-sealed at its lower margins as indicated at 13*a* to the front and back walls 5 and 7 of the bag. The seals at 13*a* extend completely across the bag. The strip or tape 13, which may be one-half inch to three-quarters of an inch wide, for example, is preferably a two-ply strip, the plies being laminated together with two wires 17 and a single tearing member 19 sealed in place between the plies. Ply 21 of the strip, which constitutes the outer ply as the strip is folded around the mouth of the bag, is preferably of paper, and the other ply 23 constituting the inner ply is preferably of a heat-sealable film such as polyethylene, e.g., 2 mil polyethylene film. Alternatively, ply 23 may be paper coated on both sides with a thermoplastic adhesive. The wires 17 extend adjacent the edges of the strip 13 and the tearing member 19, which may be a wire or cord, extends generally along the longitudinal central line of the strip. As supplied, the plies 21 and 23 are heat-sealed together with the two wires 17 and the tearing member interposed and sealed in place therebetween. Also, the outside surface of ply 23 is preferably treated so that it adheres better to paper than to itself, as by corona discharge treatment, or a suitable oxidation or other treatment.

After the bag 1 has been filled with product, its mouth edge may be trimmed to remove irregularities, if any, and with the upper portions of the bag walls 5 and 7 pressed flatwise together and with the upper portions of the gussets 9 intucked between the walls, the strip 13 is folded uniformly over the mouth edge of the bag with ply 23 on the inside, with wires 17 below and tearing member 19 above the mouth edge, and the strip is heat-sealed as indicated at 13*a* to the bag walls, overlying the walls. As this sealing operation is carried out, the upper end portions of the two halves of each gusset 9 also become heat-sealed together on account of the adhesive at 11, and this heat-sealing of the gussets in conjunction with the heat-sealing of the strip 13 to the bag and the heat-sealing together of the inside faces of the strip in the ears 15 of the strip as indicated at 23*a* in FIG. 5 effects substantially sift-proof closure of the bag. While the inside faces of the strip are sealed together in the ears, the seal is relatively weak due to the above-noted corona discharge or other treatment of these faces, and in any event is weaker than the seal to the paper walls of the bag. The inside faces of the strip may also be weakly heat sealed together above the mouth edges of the bag walls as indicated at 23*b* in FIG. 6. Also, a slit or nick 25 is formed at one end of the folded strip between the tearing member 19 and the wires 17, providing a free end portion 27 of the strip and the tearing member 19 above the nick adapted readily to be grasped and pulled to tear the strip to open the bag. The nick may be formed simultaneously with the heat-sealing of the strip to the bag.

After the strip 13 has been applied to seal the bag, the ears 15 may be folded over on one face of the bag, and the upper portion of the bag folded over and releasably adhered as by a relatively weak adhesive at 29 to form a flat top 31 for the filled bag as shown in FIG. 1.

Figure 8:
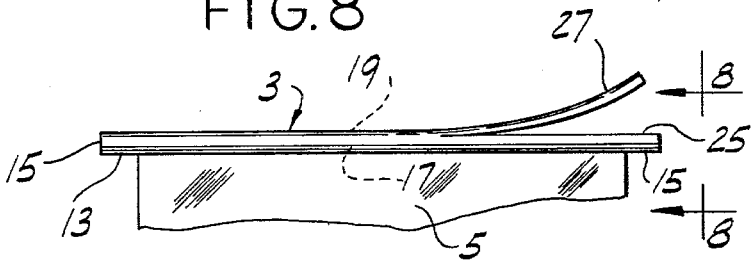
FIG. 8 is a view of the top of FIG. 3 showing the closure partially torn open.

To open the bag, the top 31 is pulled up from the FIG. 1 position to a position as shown in FIGS. 2 and 3, and the end of the tearing member 19 and portion of the strip 13 above the nick 25 at 27 are grasped and pulled as shown in FIG. 8 to open the bag by tearing open the strip 13. Pulling on the tearing member tears both plies of both halves of the folded strip 13 above the mouth edges of the bag to open the bag. The tearing generally starts at the inner end of the nick 25 and continues generally parallel to the mouth edges of the bag walls all the way across the bag.

Figure 10:
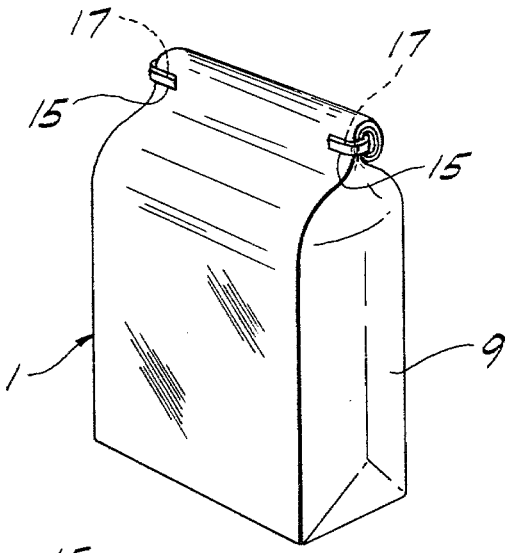
FIG. 10 is a perspective showing the bag reclosed.

To reclose the bag, the top of the bag may be folded upon itself one or more times (in effect to form a pinch top closure) and the ears 15 including the ends of the closure wire elements 17 are bent over as illustrated in FIG. 10 to maintain the reclosure. Then, to re-open the bag, the ears including the ends of the wires are simply bent back out.

Figure 9:
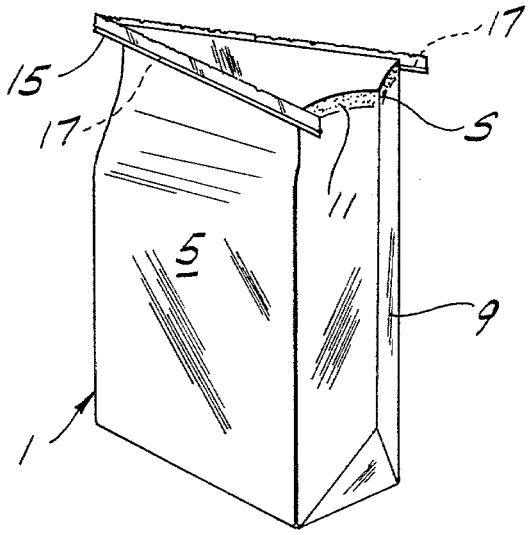
FIG. 9 is a perspective of the bag opened and formed to provide a pouring spout.

As shown in FIG. 9, after the strip 13 has been torn open, its two halves may be readily separated at an ear 15 (as permitted by the above-noted corona discharge or other treatment) to enable the gusset at the respective corner of the bag to be formed into a pouring spout S.

Each of the wires 17 is of such metal and diameter as to enable it to be readily bent and to retain its bent form for reclosing the bag. Wires of a soft, ductile metal, such as annealed steel wire of 0.017 to 0.025 inch in diameter, have been found to be satisfactory. Each wire extends lengthwise of the two-ply strip 13 between its plies adjacent the edges of the strip means on the outside of one of the walls of the bag below the respective mouth edge 5*a*, 7*a* of the wall a short distance (e.g. 3/16 of an inch), and remains on the bag wall after the tearing member 19 has been pulled from the bag to tear the strip as shown in FIG. 8. While two wires 17 are shown in FIGS. 5–8, it will be understood that the strip 13 may carry only one wire or more than two. Metal strips may be used instead of wires of circular cross-section.

The tearing member 19 extends along the strip 13 between plies 21 and 23 of the strip within the fold 33 of the strip a short distance (e.g., 1/16 of an inch) above the mouth edges 5*a*, 7*a* of the bag. The tearing member and the fold 33 are generally on the longitudinal center line of the strip. The tearing member may comprise a wire of the same metal and diameter as a wire 17, or a length of line such as a suitable thread or twine having sufficient tensile strength to enable it to tear the two plies of the strip above the mouth of the bag. The ply 23 may be scored or perforated on lines (not shown) extending throughout its length just above the wires 17 (and below the tearing member 19) to facilitate the tearing of the strip 13.

Figure 11:
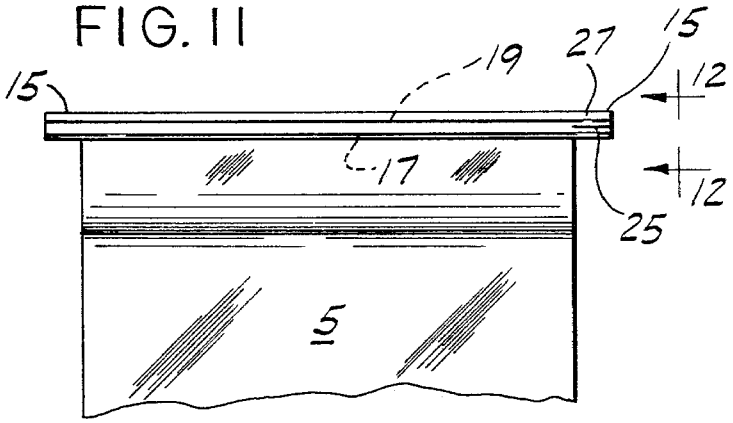
FIG. 11 is a view similar to FIG. 3 showing a second embodiment of the top closure.
Figure 12:
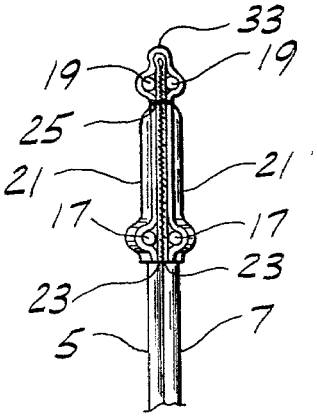
FIG. 12 is an enlarged right side view of the top of the FIG. 11 bag on line 12—12 of FIG. 11.

FIGS. 11 and 12 illustrate a second and perhaps preferred embodiment of the top closure similar to the first embodiment of FIGS. 1–8 except that it has two tearing members instead of one, each again designated 19, extending lengthwise of the two-ply strip 13 between the plies and located on opposite sides of the longitudinal center line of the strip 13 so as to lie at opposite sides of the strip a short distance below the fold 33 and a short distance above the mouth edges 5*a*, 7*a* of the bag walls 5, 7 when the strip 13 is folded around the mouth of the bag and sealed to the bag walls. The tearing members here may be of the same material as the tearing member of the first embodiment (wire or thread or twine). Here again the strip 13 has the nick 25 below the tearing members 19 and the free end portion 27 of the strip and members 19 above the nick enabling these members to be grasped and pulled to tear the strip 13 to open the bag. As in the first embodiment, the strip 13 may have one closure wire 17, two wires 17 as shown, or more than two wires.

Figure 13:
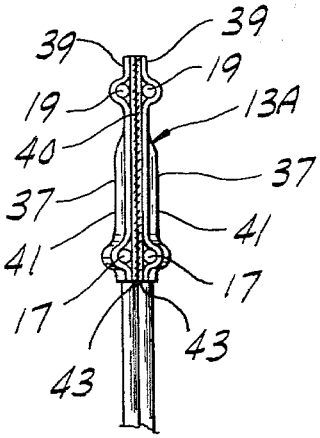
FIG. 13 is a view similar to FIG. 12 showing a third embodiment of the top closure.

FIG. 13 illustrates a third embodiment similar to the second except that the strip means, here designated 13A to distinguish it from the single strip 13, comprises two two-ply strips each designated 37 and each having a width generally half that of the strip 13, these strips 37 having upper portions 39 extending above the mouth edges *5a, 7a* of the bag walls, these upper portions being heat-sealed together at 40. Each of the strips 37 comprises two plies 41, 43 of materials sealed together, with a wire 17 and a tearing member 19 between the two plies. The outer ply 41 may be formed of the same material as the outer ply 21 of the first two embodiments and the inner ply 43 may be of the same material as the inner ply 23 of the first two embodiments. In contrast to the inner ply 23 of the first two embodiments, the inner plies 43 may not be corona-discharge treated or oxidized at the upper portion thereof so that a sift-proof, permanent seal may be formed above the mouth of the bag. As in the first and second embodiments, strip means 13A has a nick extending inwardly from one of its ends below the tearing members 17, the nick facilitating the grasping and pulling of the tearing members.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bag having opposed walls and a top closure closing the mouth of the bag adapted to be opened for opening the bag at its mouth and for reclosing the bag, said top closure comprising closure strip means extending around the mouth of the bag from one wall of the bag to the other overlying and sealed to the outside of the walls, the ends of the closure strip means projecting outwardly beyond the sides of the bag and forming ears, a pair of closure elements carried by the strip means extending lengthwise thereof, each comprising a length of wire, and a tearing member carried by the strip means extending lengthwise thereof above the mouth edges of the walls and above the closure elements, the strip means, in condition as sealed to the walls, being of uniform width along its entire length and comprising two plies of material sealed together, the tearing member and the closure elements being between said plies, extending the entire length of the strip means, and having ends generally flush with the ends of the strip means, the bag being adapted to be opened by grasping the tearing member at an end thereof and pulling it to tear the closure strip means, the portions of the closure elements in the ears projecting outwardly beyond the sides of the bag being adapted to be bent to reclose the bag.

2. A bag as set forth in claim 1 wherein the closure elements are on the outside of the bag walls below the mouth edges thereof.

3. A bag as set forth in claim 2 wherein the strip means on its side facing the walls of the bag is heat-sealable, and is heat-sealed to the walls.

4. A bag as set forth in claim 1 wherein the inside ply of the two plies is heat-sealable on its side toward the outside ply and is heat-sealed to the latter.

5. A bag as set forth in claim 4 wherein the inside ply is heat-sealable on its other side and is heat sealed to the bag walls, the portions of the folded strip in the ears being heat-sealed together.

6. A bag as set forth in claim 5 wherein the portions of the folded strip in the ears are releasably heat-sealed together.

7. A bag as set forth in claim 6 having gussets intucked between the bag walls at the top of the bag, the two halves of each gusset being heat-sealed together at the top of the bag.

8. A bag as set forth in claim 7 wherein the two halves of each gusset are releasably heat-sealed together at the top of the bag, and the portions of the folded strip in the ears are releasably heat-sealed together.

9. A bag as set forth in claim 1 wherein the strip means comprises two individual strips each sealed to one of the walls and having an upper portion extending above the mouth edges of the walls, the upper portions of the two strips being sealed together.

10. A bag as set forth in claim 1 wherein the tearing member is on one side of the top closure and a second tearing member is provided on the other side of the tearing member, the bag being adapted to be opened by grasping both the first and second tearing members at one end of the strip means and pulling to tear the strip means.

11. A bag as set forth in claim 10 wherein the strip means has a slit extending inwardly from one of its ends below the tearing members, the slit facilitating the grasping and pulling of the tearing members.

12. A bag as set forth in claim 1 wherein the strip means has a slit extending inwardly from one of its ends below the tearing member providing a free end facilitating the grasping and pulling of the tearing member.

13. A bag having opposed walls, gussets intucked between the bag walls at the top of the bag, and a top closure closing the mouth of the bag adapted to be opened for opening the bag at its mouth and for reclosing the bag, said top closure comprising closure strip means extending around the mouth of the bag from one wall of the bag to the other overlying and sealed to the outside of the walls, the ends of the closure strip means projecting outwardly beyond the sides of the bag and forming ears, a closure element carried by the strip means extending lengthwise thereof, and a tearing member carried by the strip means extending lengthwise thereof above the mouth edges of the walls and above the closure element, the bag being adapted to be opened by grasping the tearing member at an end thereof and pulling it to tear the closure strip means, the portions of the closure element in the ears projecting outwardly beyond the sides of the bag being adapted to be bent to reclose the bag, the strip means on its side facing the walls of the bag being heat-sealable and treated so that it is adapted to adhere more strongly to the bag than to itself and being permanently heat-sealed to the walls of the bag, the end portions of the strip means in the ears being releasably heat-sealed together, the gussets on the outside surfaces thereof having a relatively low-strength thermoplastic adhesive thereon, the two halves of each gusset being heat-sealed together at the top of the bag, this heat-sealing of the gussets in conjunction with the permanent heat-sealing of the strip means to the bag and the releasable heat-sealing together of said end portions of the strip means in the ears effecting a substantially sift-proof closure of the bag while enabling the two halves of the gusset to be separated, after the bag has been opened, for forming one of the gussets into a pouring spout.

14. A bag as set forth in claim 13 wherein the strip means comprises a single strip folded around the mouth of the bag.

15. A bag as set forth in claim 14 wherein the strip comprises two plies of material sealed together, the tearing member and the closure element being between said plies.

16. A bag as set forth in claim 15 wherein the inside ply of the two plies is heat-sealable on its side toward the outside ply and is heat-sealed to the latter.

17. A bag as set forth in claim 13 wherein the closure element is on the outside of one of the bag walls below the mouth edge thereof.

18. A bag as set forth in claim 17 wherein said top closure includes a second closure element carried by the strip means extending lengthwise thereof on the outside of the other of the bag walls below the mouth edge thereof.

19. A bag as set forth in claim 13 wherein the tearing member is on one side of the top closure and a second tearing member is provided on the other side of the tearing member, the bag being adapted to be opened by grasping both the first and second tearing members at one end of the strip means and pulling to tear the strip means.

20. A bag as set forth in claim 19 wherein the strip means has a slit extending inwardly from one of its ends below the tearing members, the slit facilitating the grasping and pulling of the tearing members.

21. A bag as set forth in claim 13 wherein the strip means has a slit extending inwardly from one of its ends below the tearing member providing a free end facilitating the grasping and pulling of the tearing member.

* * * * *

UNITED STATES PATENT AND TRADEMARK OFFICE

CERTIFICATE OF CORRECTION

PATENT NO. : 4,301,925

DATED : November 24, 1981

INVENTOR(S) : William M. Bogart

It is certified that error appears in the above—identified patent and that said Letters Patent is hereby corrected as shown below:

Column 2, line 38, "strips" should read -- stripes --.
Column 6, line 6, "claim 6" should read -- claim 5 --.

Signed and Sealed this

*Twenty-third* Day of *March 1982*

|SEAL|

*Attest:*

GERALD J. MOSSINGHOFF

*Attesting Officer*

*Commissioner of Patents and Trademarks*